US012553240B1

(12) United States Patent
Rogers

(10) Patent No.: US 12,553,240 B1
(45) Date of Patent: Feb. 17, 2026

(54) SUPPORT ASSEMBLY FOR A BUILDING MATERIAL

(71) Applicant: Craig Rogers, Gurnee, IL (US)

(72) Inventor: Craig Rogers, Gurnee, IL (US)

( * ) Notice: Subject to any disclaimer, the term of this patent is extended or adjusted under 35 U.S.C. 154(b) by 0 days.

(21) Appl. No.: 19/252,748

(22) Filed: Jun. 27, 2025

(51) Int. Cl.
*E04F 21/18* (2006.01)
*E04B 2/72* (2006.01)
*E04C 3/00* (2006.01)

(52) U.S. Cl.
CPC ..... *E04C 3/005* (2013.01); *E04B 2/721* (2013.01); *E04B 2/723* (2013.01)

(58) Field of Classification Search
CPC ..... E04C 3/005; E04B 2/721; E04B 2/723; E04F 21/1822; E04F 21/1811; E04F 21/1805; E04F 21/18; E04F 21/185
See application file for complete search history.

(56) References Cited

U.S. PATENT DOCUMENTS 2,969,220 A 1/1961 Spencer
4,120,484 A * 10/1978 Zimmer ..... E04F 21/1811 414/11
4,560,031 A * 12/1985 Dixon ..... E04F 21/1811 182/115
6,773,218 B1 * 8/2004 Mingoes ..... E04F 21/1811 254/105
7,448,598 B1 11/2008 Elmlinger
7,997,846 B2 * 8/2011 Brunson ..... E04F 21/1811 187/244
9,422,731 B2 8/2016 Gower
2001/0029715 A1 10/2001 Bradley
2005/0257492 A1 * 11/2005 Miller ..... E04F 21/22 52/749.1
2008/0040988 A1 * 2/2008 Holt ..... E04F 21/185 52/745.12

* cited by examiner

*Primary Examiner* — Lynn E Schwenning
(74) *Attorney, Agent, or Firm* — Miller Johnson

(57) ABSTRACT

A support assembly for a building material includes a mounting portion configured to selectively mount the support assembly to a wall frame. A support platform is coupled to the mounting portion. The support platform has a support surface configured to support the building material. A lift mechanism including a rack is coupled to the support platform. A worm gear is operably coupled to the rack and rotatably coupled to the mounting portion. The lift mechanism is configured to selectively raise and lower the support platform relative to the mounting portion upon rotation of the worm gear.

21 Claims, 5 Drawing Sheets

SUPPORT ASSEMBLY FOR A BUILDING MATERIAL

FIELD

The present disclosure relates to building materials and tools and more particularly to tools used in the construction of walls.

BACKGROUND

In the course of building, construction, or remodeling projects, such as for residential or commercial buildings, there are some tasks or steps that can be difficult to complete without more than one person working together. One such example is in the assembly or construction of walls that require the application of a building material, such as a sheet or panel of drywall, sheet rock, or other materials of similar structure, to be mounted to a wall frame. Such building panels are typically supplied in large formats. In one example, sheets of drywall can be supplied in panels that are 4 feet by 8 feet, 12 feet, or even 16 feet.

When mounting drywall sheets of that size, at least two people are typically required, with one or more persons holding the panel in the desired mounting location, and another person applying the fasteners to attach the panel to the wall frame. This need for multiple personnel for wall-building tasks can increase costs and logistical difficulty in construction projects, and can make it difficult for individuals, such as homeowners, to be able to complete wall construction projects, such as drywalling, on their own. Thus, there is a need for drywall support tools or assemblies that can aid in holding drywall sheets in a desired position for mounting to the wall frame, which could enable a single user to perform the task of drywall mounting.

Previous solutions that have attempted to address this challenge include drywall braces or supports that hold a sheet of drywall in a raised position, such as braces that extend between a floor and the sheet of drywall. However, such brace assemblies can be heavy and cumbersome to a user, may be tedious to assemble into place, and are not easily adjustable once supporting the weight of the sheet of drywall. Other approaches have included drywall braces that require fastening to a portion of the wall, such as by screws or by nails. Again, such approaches fail to offer flexibility to the user, as they are not easily repositioned, and would require the user to remove the sheet of drywall from the device in order to reposition the sheet of drywall. Thus, there is a need in the art for a drywall support that is easily portable, quickly attached and detached from the wall to allow for ease of use, and that would allow for adjustment in the position of the sheet of drywall supported by the device without having to remove the sheet of drywall and reposition the entire device for each adjustment.

The background description provided here is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

SUMMARY

This section provides a general summary of the disclosure, and is not a comprehensive disclosure of its full scope or all of its features.

One aspect of the disclosure provides a support assembly for a building material. The support assembly includes a mounting portion configured to selectively mount the support assembly to a wall frame. A support platform is coupled to the mounting portion and has a support surface configured to support the building material. A lift mechanism including a rack is coupled to the support platform. A worm gear is operably coupled to the rack and rotatably coupled to the mounting portion. The lift mechanism is configured to selectively raise and lower the support platform relative to the mounting portion upon rotation of the worm gear.

Another aspect of the disclosure provides a lift assembly for supporting and raising a building material. The lift assembly includes a support body. A support platform is movably coupled to the support body and has a support surface configured to support the building material. A lift mechanism is operably coupled to the support platform and configured to selectively raise and lower the support platform relative to the support body. The lift mechanism includes a rotatable actuator coupled to the support body, a worm gear operably coupled to the rotatable actuator, and a rack and pinion assembly. The rack and pinion assembly is operably coupled to the worm gear and to the support platform. The rack and pinion assembly is configured to selectively raise and lower the support platform relative to the support body upon rotation of the rotatable actuator and the worm gear.

Further areas of applicability of the present disclosure will become apparent from the detailed description, the claims, and the drawings. The detailed description and specific examples are intended for purposes of illustration only and are not intended to limit the scope of the disclosure.

BRIEF DESCRIPTION OF THE DRAWINGS

The present disclosure will become more fully understood from the detailed description and the accompanying drawings.

In the drawings, reference numbers may be reused to identify similar and/or identical elements.

DETAILED DESCRIPTION

Figure 1:
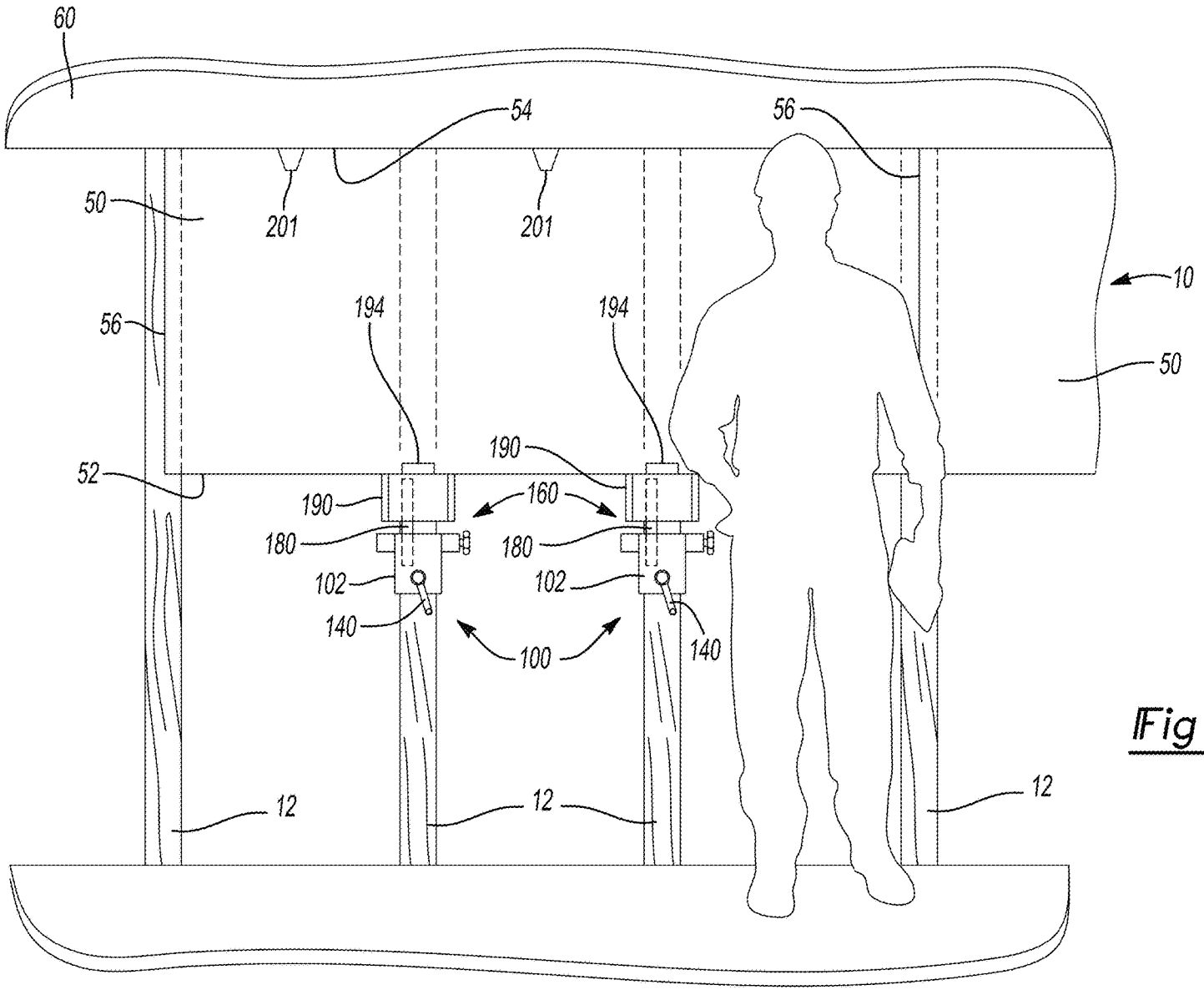
FIG. 1 is a front view of a portion of a wall frame with two support and lift assemblies for a building material supporting the building material against the wall frame, in accordance with aspects of the present disclosure.

FIG. 1 illustrates a wall frame 10 including a plurality of upright frame members, illustrated herein as wall frame studs 12. The wall frame studs 12 can be generally vertically positioned. By way of non-limiting example, the wall frame studs 12 can be formed by 2×4 lumber members, though it will be understood that any other suitable building material may be used.

Building materials, including building panels, illustrated herein as drywall sheets 50, can be mounted to the wall frame 10 via the wall frame studs 12. While the building panel is illustrated herein as the drywall sheet 50, it will be understood that any suitable building material sheets or panels can be used, non-limiting examples of which include panels of drywall, plywood, sheetrock, etc. of varying sizes and lengths, for attachment to the wall frame 10. The drywall sheet 50 includes a lower edge 52, an upper edge 54, and opposing side edges 56 when positioned in the desired orientation against the wall frame studs 12 for attachment to the wall frame 10.

At least one building material support and lift assembly, illustrated herein as a drywall support and lift assembly 100 is mounted to a portion of the wall frame 10, such as to a portion of one of the wall frame studs 12. As shown, more than one drywall support and lift assembly 100 can be used in mounting the drywall sheet 50, such that each of the drywall support and lift assemblies 100 is attached to a respective wall frame stud 12. In this way, at least one drywall support and lift assembly 100 can be used to support the drywall sheet 50 and lift the drywall sheet 50 into place for fastening to the wall frame 10 by a user, without the need for an additional worker to hold the drywall sheet 50 in place.

The drywall support and lift assembly 100 includes a support body 102 carrying a rotatable actuator, illustrated herein as a crank handle 140, that is rotatably coupled to the support body 102 for selectively actuating the drywall support and lift assembly 100. The drywall support and lift assembly 100 further includes a mounting portion 160 for selectively mounting the drywall support and lift assembly 100 to the wall frame 10, and specifically to the wall frame stud 12. A support platform 190 is movably coupled to the support body 102 and the mounting portion 160 and is configured to support the drywall sheet 50 at the lower edge 52 for mounting to the wall frame 10. A retaining rib 194 protrudes upwardly from the support platform 190 and is configured to retain the drywall sheet 50 against the wall frame 10 and the wall frame studs 12 so that the lower edge 52 of the drywall sheet 50 is prevented from sliding away from the wall frame studs 12 or sliding off of the support platform 190.

The support platform 190 is movably coupled within the drywall support and lift assembly 100 such that the support platform 190 is configured to be selectively raised and lowered relative to the support body 102 and the mounting portion 160. The drywall support and lift assembly 100 further includes a lift mechanism, including a rack 180, that is operably coupled with the crank handle 140 and with the support platform 190, such that operation of the crank handle 140 by the user actuates the lift mechanism of the drywall support and lift assembly 100, including the rack 180, to selectively raise and lower the support platform 190 between a lowered position (FIG. 2) and a raised position, as shown. This allows the user to make fine adjustments to the positioning of the drywall sheet 50 for attachment to the wall frame 10 when the drywall sheet 50 is already supported by the support platform 190, without requiring removal of the drywall sheet 50 from the drywall support and lift assembly 100. For example, once the drywall sheet 50 is supported on the support platform 190, the user can actuate the lift mechanism of the drywall support and lift assembly 100 to raise the drywall sheet 50 into a desired position where the drywall sheet 50 contacts or is flush with a ceiling 60 above the wall frame 10.

At least one upper retainer 201 can also be provided with the drywall support and lift assembly 100. The at least one upper retainer 201 can be thought of as a separate piece forming a part of the drywall support and lift assembly 100, or the at least one upper retainer 201 and the drywall support and lift assembly 100 can be thought of as collectively forming a kit for effective retention of the drywall sheet 50. The at least one upper retainer 201 can be fastened to a surface adjacent the drywall sheet 50, such as to the ceiling 60, to further aid in retaining the drywall sheet 50 against the wall frame 10. In the non-limiting example wherein the at least one upper retainer 201 is coupled to the ceiling 60, the at least one upper retainer 201 can prevent the upper edge 54 of the drywall sheet 50 from tilting or falling away from the wall frame 10. The at least one upper retainer 201 can be attached to the ceiling 60 by any suitable attachment means, non-limiting examples of which include through the use of mechanical fasteners, such as screws, bolts, or staples, through the use of suction, or through the use of adhesives.

Figure 2:
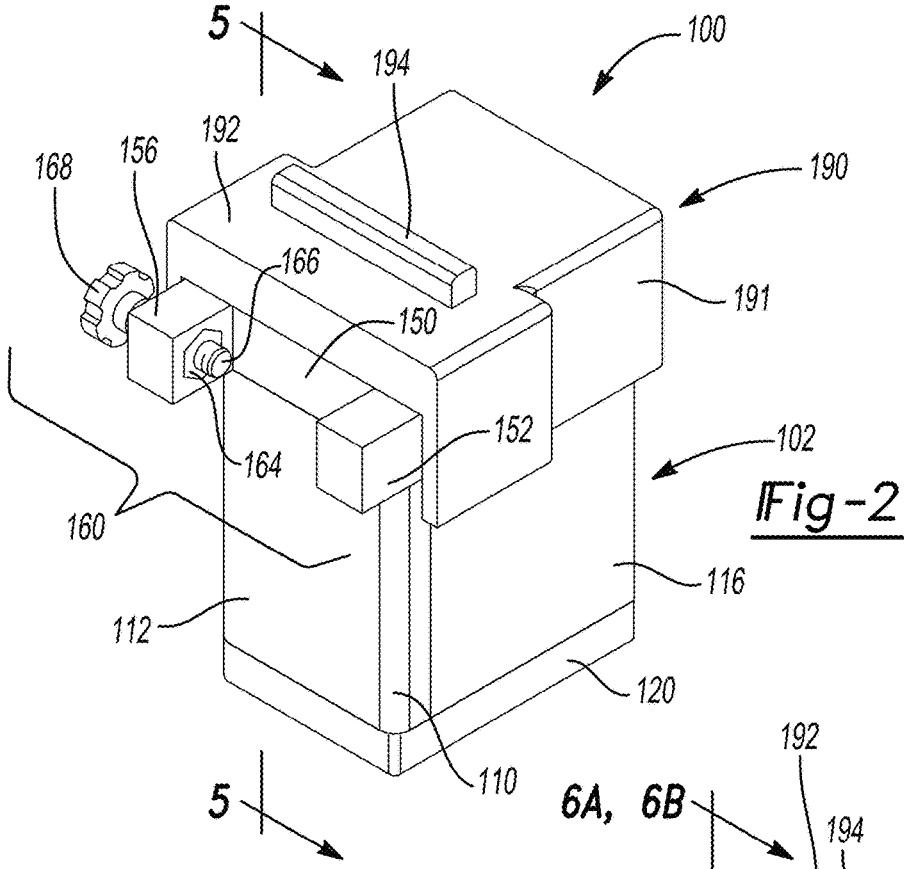
FIG. 2 is a rear perspective view of one of the support and lift assemblies of FIG. 1.
Figure 3:
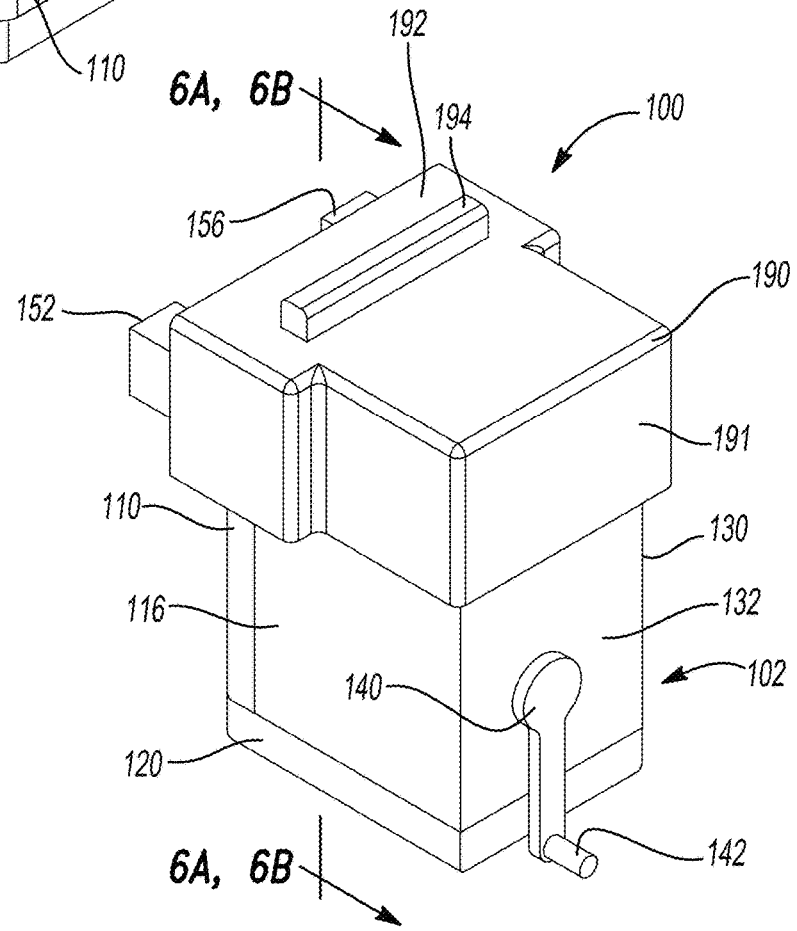
FIG. 3 is a front perspective view of the support and lift assembly of FIG. 2.

The views of FIGS. 2 and 3 illustrate the drywall support and lift assembly 100 with the support platform 190 in the lowered position and removed from the wall frame stud 12 so that the structure of the drywall support and lift assembly 100 can be seen. Referring to FIG. 2, the support body 102 includes a first body portion 110 having a rear wall 112 and a first side wall 116, and a bottom wall 120. It will be understood that the rear wall 112, the first side wall 116, and the bottom wall 120 can be collectively thought of as forming the first body portion 110, or the first body portion 110 can include only the rear wall 112 and the first side wall 116, with the bottom wall 120 being provided as a separate piece that is attached to the first body portion 110 by fastening means.

The support body 102 further includes a top wall 150 that includes and at least partially forms the mounting portion 160. The top wall 150 includes first and second mounting arms 152 and 156 extending from the top wall 150 generally parallel to one another and spaced apart from one another about the top wall 150. The first and second mounting arms 152, 156 extend from the support body 102 to at least partially form the mounting portion 160. When the drywall support and lift assembly 100 is positioned such that the rear wall 112 is against the wall frame stud 12, the first and second mounting arms 152, 156 extend along opposite faces or sides of the wall frame stud 12.

One of the first and second mounting arms 152, 156, illustrated herein as the second mounting arm 156, can receive a nut 164 through which a bolt 166 is selectively threaded. The bolt 166 can be provided with a cap or a head, illustrated herein as a knob 168, by which the user can rotate the bolt 166 to selectively bear against and clamp to the wall frame stud 12. The user can rotate the bolt 166 by the knob 168 in a first direction to tighten the bolt 166 against the wall frame stud 12, and in an opposite direction to release the bolt 166 from the wall frame stud 12. In this way, the first and second mounting arms 152, 156, along with the nut 164, the bolt 166, and the knob 168, can be thought of as collectively forming a clamping mechanism of the mounting portion 160, such as by collectively acting as a C-clamp to mount the mounting portion 160 to the wall frame stud 12.

The support platform 190 includes a sidewall 191 extending downwardly from a support surface 192 to at least partially surround an upper portion of the support body 102. The retaining rib 194 extends upwardly from the support surface 192 on which the drywall sheet 50 can be supported. In the illustrated example, the sidewall 191 of the support platform 190 has a profile that is generally complementary to that of the top wall 150 of the support body 102, though it is understood that such a shape or profile is not limiting.

In the perspective view of FIG. 3, a second body portion 130 of the support body 102 can be seen. While the first body portion 110 has the rear wall 112 and the first side wall 116, the second body portion 130 includes a front wall 132 and a second side wall 136 (FIG. 4) collectively forming the second body portion 130. Further, while the rear wall 112 is configured to be positioned against the wall frame stud 12, the front wall 132 is positioned opposite the rear wall 112 and carries the crank handle 140. The crank handle 140 includes a grip portion 142 configured to be grasped by a user to allow the user to rotate the crank handle 140 and actuate the drywall support and lift assembly 100 to selectively raise or lower the support platform 190.

Figure 4:
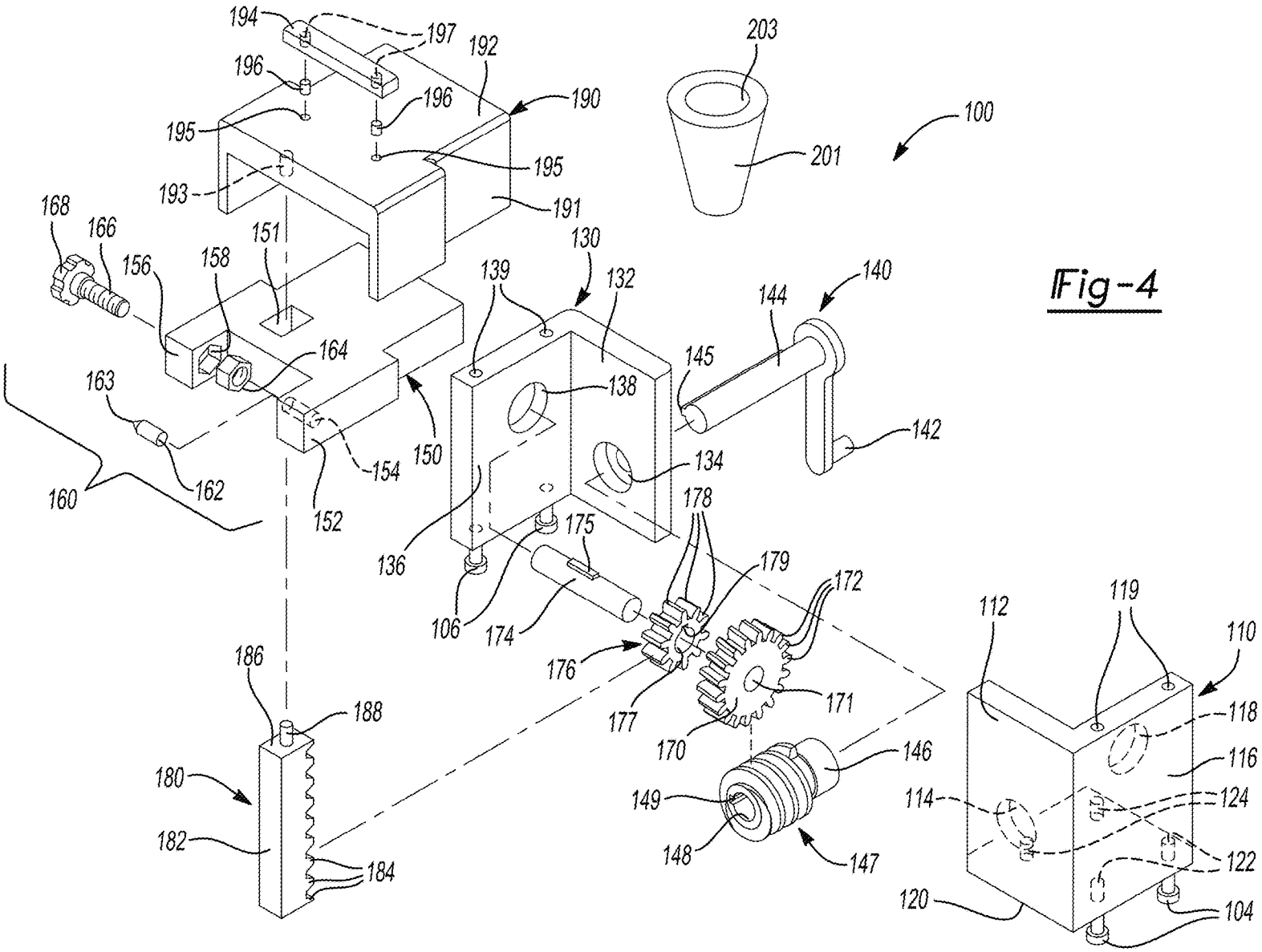
FIG. 4 is an exploded view of the support and lift assembly of FIG. 2.

The exploded view of FIG. 4 better illustrates the internal components of the drywall support and lift assembly 100. In the first body portion 110, the rear wall 112 defines a rear wall aperture 114, while the first side wall 116 defines a first side wall aperture 118. The first side wall 116 can also define a set of first side wall fastener openings 119. Similarly, the bottom wall 120 can define a set of first fastener openings 122 and a set of second fastener openings 124, with the first fastener openings 122 of the bottom wall 120 aligning with the first side wall fastener openings 119 in the first side wall 116. Likewise, in the second body portion 130, the front wall 132 defines a front wall aperture 134, while the second side wall 136 defines a second side wall aperture 138. The second side wall 136 can also define a set of second side wall fastener openings 139, with the second fastener openings 124 of the bottom wall 120 aligning with the second side wall fastener openings 139 in the second side wall 136 when the support body 102 is assembled.

When the bottom wall 120 is provided as a separate piece from the first and second body portions 110, 130, sets of first and second fasteners 104, 106 can be used to assemble the support body 102. Specifically, the first fasteners 104 can pass through the set of first fastener openings 122 in the bottom wall 120, through the first side wall fastener openings 119 in the first side wall 116, and into the top wall 150 to assemble the support body 102. Similarly, the second fasteners 106 can pass through the set of second fastener openings 124 in the bottom wall 120, through the second side wall fastener openings 139 in the second side wall 136, and into the top wall 150 to complete the assembly of the support body 102. However, it is understood that, in the case that the bottom wall 120 is integrally formed with either of the first and second body portions 110, 130, the first and second fasteners 104, 106, along with the first and second fastener openings 122, 124 and the first and second side wall fastener openings 119, 139, would not be necessary to be included with the support body 102.

The exploded view further illustrates better the complementary shape and profile of the top wall 150 and the support platform 190. The top wall 150 further defines a top wall aperture 151 through which the rack 180 can pass. Further yet, the first mounting arm 152 defines a channel 154 within which a pin 162 is at least partially received. The pin 162 includes a pointed (e.g., conical) end 163 that at least partially protrudes inwardly from the first mounting arm 152, such that the pointed end 163 is positioned to grip into the wall frame stud 12 to aid in clamping the mounting portion 160 to the wall frame stud 12. The second mounting arm 156 also defines a nut opening 158 within which the nut 164 is mounted.

The lift mechanism of the drywall support and lift assembly 100 further includes a worm gear operably coupled with the crank handle 140, the worm gear including a worm drive shaft 144 carrying a worm 146, a worm wheel 170, and a worm output shaft 174. The worm drive shaft 144 is fixedly and operably coupled with the crank handle 140, such that rotation of the crank handle 140 also rotates the worm drive shaft 144. The worm drive shaft 144 includes a drive shaft rib 145 extending along at least a portion of the length of the worm drive shaft 144. The worm drive shaft 144 extends through the front wall aperture 134 to be received within the rear wall aperture 114 to couple the crank handle 140 to the support body 102, such that the crank handle 140 and the worm drive shaft 144 are rotatably coupled to the support body 102. Ball bearings (not shown) can be included between the worm drive shaft 144 and the front and rear wall apertures 134, 114 to ensure smooth rotation of the worm drive shaft 144 and the crank handle 140 relative to the support body 102.

The worm 146 defines a central longitudinal opening 148 within which the worm drive shaft 144 is at least partially received to mount the worm 146 to the worm drive shaft 144. The central longitudinal opening 148 can further define a longitudinal channel 149 within which the drive shaft rib 145 can be received to prevent rotation of the worm 146 relative to the worm drive shaft 144 and to ensure that the worm drive shaft 144 and the worm 146 rotate simultaneously and coaxially with one another. The worm 146 defines an exterior threaded portion 147 extending outwardly away from the worm drive shaft 144.

The worm wheel 170 defines an interior worm wheel opening 171 and a plurality of teeth 172 extending outwardly from the worm wheel 170. The teeth 172 of the worm wheel 170 enmesh with the threaded portion 147 of the worm 146 to operably couple the worm wheel 170 to the worm 146. The worm output shaft 174 is at least partially received within the worm wheel opening 171 such that the worm wheel 170 is mounted to the worm output shaft 174. Specifically, the worm wheel 170 is operably coupled with the worm output shaft 174 such that rotation of the worm wheel 170 also rotates the worm output shaft 174.

The worm output shaft 174 can further define a lug 175 protruding from a portion of the length of the worm output shaft 174 at a position on the worm output shaft 174 that is not received within the worm wheel opening 171 of the worm wheel 170. The worm output shaft 174 extends at least partially through and is received within the first and second side wall apertures 118, 138 to couple the worm output shaft 174 to the support body 102, such that the worm output shaft 174 is rotatably coupled to the support body 102. Ball bearings (not shown) can be included between the worm output shaft 174 and the first and second side wall apertures 118, 138 to ensure smooth rotation of the worm output shaft 174 relative to the support body 102.

The lift mechanism of the drywall support and lift assembly 100 further includes a rack and pinion assembly operably coupled with the components of the worm gear, the rack and pinion assembly including a pinion gear 176 and the rack 180. The pinion gear 176 defines an interior pinion gear opening 177 and a plurality of teeth 178 extending outwardly away from the pinion gear 176. The worm output shaft 174 is at least partially received within the pinion gear opening 177 to mount the pinion gear 176 to the worm output shaft 174. The pinion gear opening 177 can further define a lug channel 179 within which the lug 175 can be received to prevent rotation of the pinion gear 176 relative to the worm output shaft 174 and to ensure that the pinion gear 176 and the worm output shaft 174 rotate simultaneously and coaxially with one another.

The rack 180 defines a linear body 182 having a toothed surface 184 and an upper surface 186 with a rack pin 188 extending upwardly from the upper surface 186. The toothed surface 184 of the rack 180 enmesh with the teeth 178 of the pinion gear 176 to operably couple the rack 180 to the pinion gear 176. Specifically, the pinion gear 176 is operably coupled with the rack 180 such that rotation of the pinion gear 176 drives linear movement in upward and downward directions of the rack 180.

When the drywall support and lift assembly 100 is assembled, the linear body 182 of the rack 180 passes through the top wall aperture 141 and the upper surface 186 of the rack 180 contacts the support platform 190. The support platform 190 defines a pin receiver 193 within which the rack pin 188 is received to operably couple the rack 180 with the support platform 190. In this way, upward linear movement of the rack 180 in turn lifts the support platform 190 away from the support body 102, while downward linear movement of the rack 180 lowers the support platform 190 back downward toward the support body 102.

The support platform 190 can further include fastener openings 195 in the support surface 192 that receive fasteners 196 to couple the retaining rib 194 to the support surface 192. The retaining rib 194 can likewise include fastener openings 197 to receive the fasteners 196. The fasteners 196 may be any suitable type of fastener, non-limiting examples of which include pegs, screws, heat stakes, etc. for coupling the retaining rib 194 to the support surface 192 of the support platform 190. It is also contemplated that the retaining rib 194 can be integrally formed with the support surface 190 and the fasteners 196 would not be needed.

The at least one upper retainer 201 can also be provided with the drywall support and lift assembly 100. The at least one upper retainer 201 can define a fastener opening 203 that allows the upper retainer 201 to be fastened to a surface, such as to the ceiling 60 above the wall frame 10. While the at least one upper retainer 201 is not coupled directly to the drywall support and lift assembly 100, the at least one upper retainer 201 can be used alongside the drywall support and lift assembly 100. In one non-limiting example, when the drywall sheet 50 being installed is the uppermost drywall sheet 50 being mounted to the wall frame 10, while the lower edge 52 of the drywall sheet 50 is supported by the drywall support and lift assembly 100, the at least one upper retainer 201 can be fastened to the ceiling 60 via the fastener opening 203 to additionally retain the upper edge 54 of the drywall sheet 50 and to ensure that the upper edge 54 of the drywall sheet 50 does not fall away from the wall frame 10.

Figure 5:
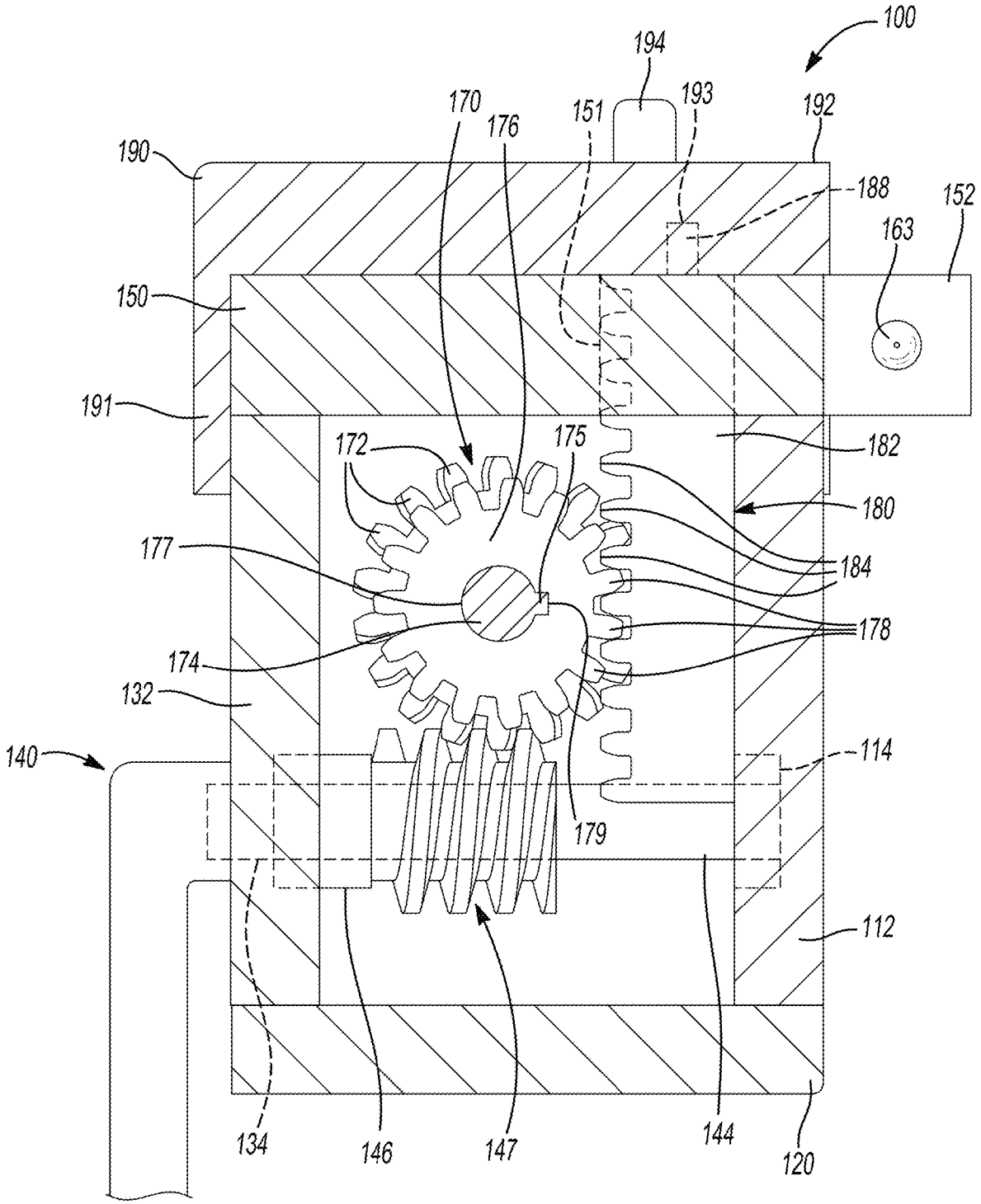
FIG. 5 is a side cross-sectional view of the support and lift assembly of FIG. 2, taken along line 5-5 of FIG. 2.

In the assembled cross-sectional view of FIG. 5, the arrangement of the components of the lift mechanism for the drywall support and lift assembly 100 are more clearly shown. The crank handle 140, the worm drive shaft 144, and the worm 146 rotate simultaneously as one about a first axis of rotation defined by the worm drive shaft 144. This rotation about the first axis of rotation defined by the worm drive shaft 144 in turn drives rotation of the worm wheel 170. The worm wheel 170, the worm output shaft 174, and the pinion gear 176 rotate simultaneously as one about a second axis of rotation defined by the worm output shaft 174. The second axis of rotation defined by the worm output shaft 174 is generally orthogonal to the first axis of rotation defined by the worm drive shaft 144. Further, this rotation of the pinion gear 176 about the second axis of rotation defined by the worm output shaft 174 in turn drives linear movement of the rack 180 in a direction defined by the longitudinal linear body 182 of the rack 180. This linear movement of the rack 180 is further generally orthogonal to both the first and second axes of rotation defined by the worm drive shaft 144 and the worm output shaft 174, respectively.

Figure 6B:
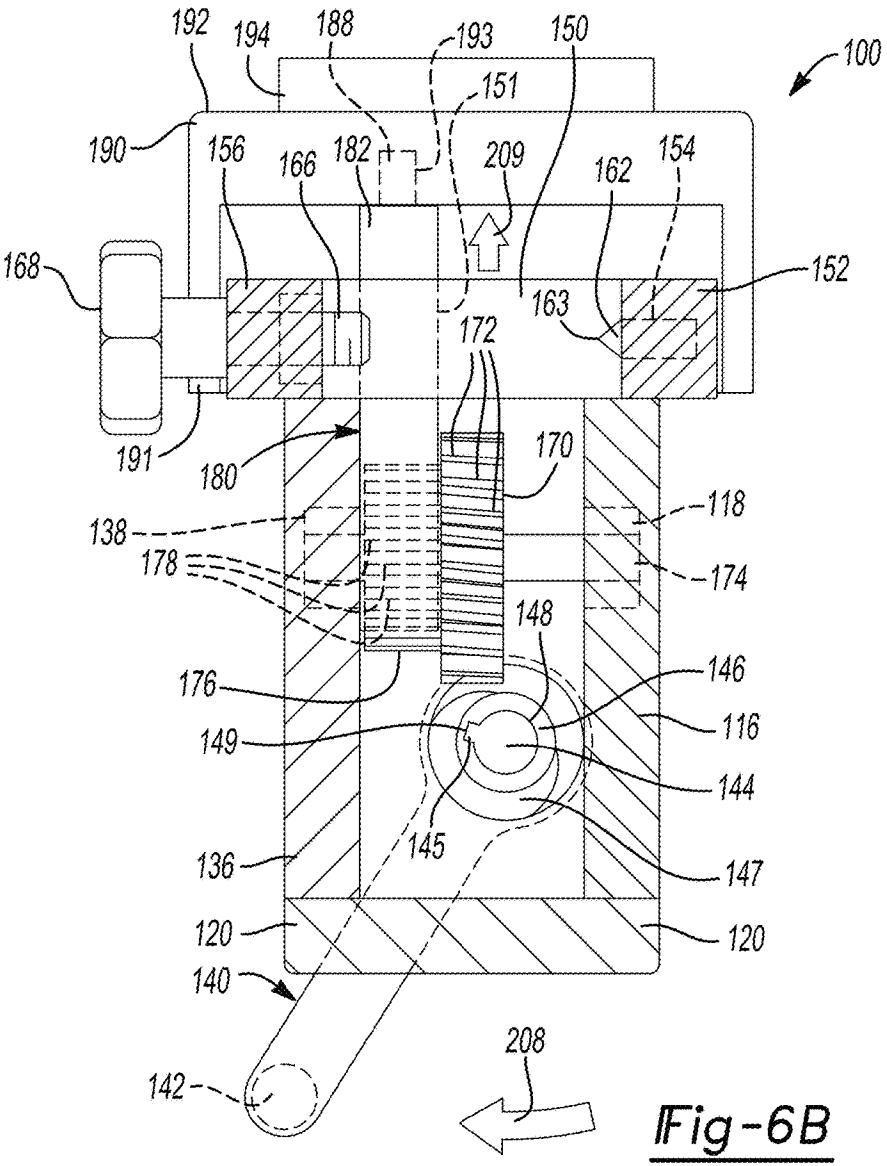
FIG. 6B is a rear cross-sectional view of the support and lift assembly of FIG. 2, taken along line 6A, 6B-6A, 6B of FIG. 3, and with a support platform of the support and lift assembly shown in a raised position.
Figure 6A:
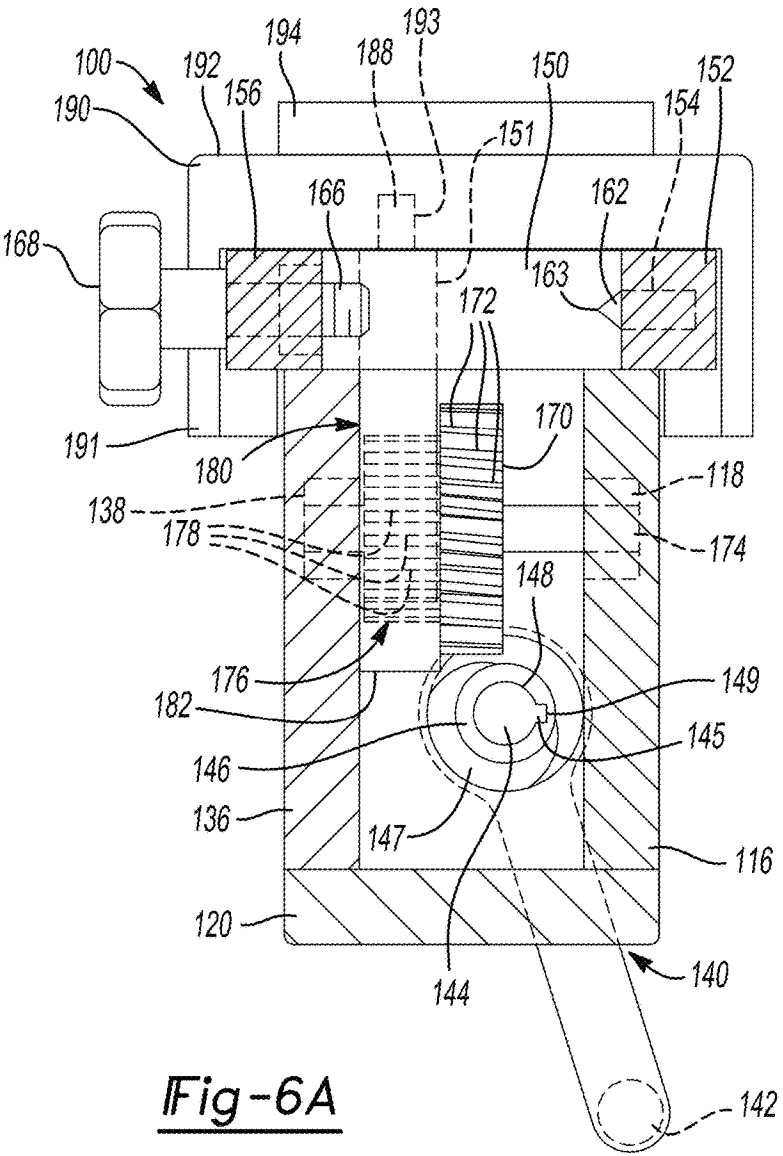
FIG. 6A is a rear cross-sectional view of the support and lift assembly of FIG. 2, taken along line 6A, 6B-6A, 6B of FIG. 3, and with a support platform of the support and lift assembly shown in a lowermost position.

Referring now to the cross-sectional views of FIGS. 6A and 6B and the operation of the drywall support and lift assembly 100, FIG. 6A illustrates the drywall support and lift assembly 100 with the rack 180 and the support platform 190 in a lowermost position. In the lowermost position, the support platform 190 rests on the top wall 150. With the rack 180 and the support platform 190 in the lowermost position, the user mounts the drywall support and lift assembly 100 to the wall frame 10 by positioning the first and second mounting arms 152, 156 of the mounting portion 160 about the wall frame stud 12. As the user rotates the knob 168 to tighten the bolt 166 against the wall frame stud 12, the pointed end 163 of the pin 162 is brought to bear against and grip into the wall frame stud 12. When the bolt 166 is fully tightened against the wall frame stud 12, the C-clamp-style cooperation between the first and second mounting arms 152, 156, the pointed end 163 of the pin 162, and the bolt 166 tightly grip the wall frame stud 12 to securely mount the drywall support and lift assembly 100 to the wall frame stud 12. The drywall sheet 50 can then be lifted onto the at least one drywall support and lift assembly 100 such that the lower edge 52 of the drywall sheet 50 rests on the support surface 192 and is retained from slipping along the support surface 192 by the retaining rib 194. By way of non-limiting example, and as illustrated in FIG. 1, a single drywall sheet 50 can be supported by two drywall support and lift assemblies 100 that are mounted to different wall frame studs 12, so that the drywall sheet 50 is more stably supported and does not have to be balanced side-to-side over the single drywall support and lift assembly 100.

In order to raise the drywall sheet 50 into the desired position for fastening to the wall frame 10, the user can then operate the drywall support and lift assembly 100 to move the support platform 190, and the drywall sheet 50 along with it, from the lowermost position of FIG. 6A to the raised position of FIG. 6B. The user can grasp the grip portion 142 of the crank handle 140 to rotate the crank handle 140 in a clockwise direction as indicated by the arrow 208. Rotation of the crank handle 140 also rotates the worm drive shaft 144 and the worm 146 with the crank handle 140 about the first axis of rotation defined by the worm drive shaft 144, causing the threaded portion 147 of the worm 146 to bear against the teeth 172 of the worm wheel 170, thus, in turn, driving rotation of the worm wheel 170 about the second axis of rotation defined by the worm output shaft 174, which is generally orthogonal to the first axis of rotation.

Rotation of the worm wheel 170 also rotates the worm output shaft 174 and the pinion gear 176 along with the worm wheel 170, causing the teeth 178 of the pinion gear 176 to bear against the toothed surface 184 of the rack 180. The rotational movement of the teeth 178 of the pinion gear 176 against the toothed surface 184 of the rack 180 drives upward linear movement of the linear body 182 of the rack 180 in the direction indicated by the arrow 209, which is generally orthogonal to both the first and second axes of rotation. As the rack 180 is driven linearly upwardly relative to the pinion gear 176, the upper surface 186 of the rack 180 and the rack pin 188 bear against the support platform 190, driving the support platform 190 to also be raised in the direction of the arrow 209. The raising of the support platform 190 in turn raises the drywall sheet 50 along with the support surface 192, relative to the wall frame 10.

When the support surface 192 has been raised enough that the drywall sheet 50 has reached the desired position for fastening to the wall frame 10, such as into a position where the drywall sheet 50 contacts, is flush with, or is adjacent to the ceiling 60, the user can cease rotational actuation of the crank handle 140. Due to the nature of the worm gear, such as due to the orthogonal, or otherwise non-coaxial, arrangement of the first axis of rotation of the worm 146 and the second axis of rotation of the worm wheel 170, and/or due to the parameters, such as angle and tread depth, of the threaded portion 147 of the worm 146 and of the teeth 172 of the worm wheel 170, when rotation of the crank handle 140 is ceased, the drywall support and lift assembly 100 maintains its raised position. More specifically, when rotation of the crank handle 140 is ceased, the worm 146 will retain the support platform 190 in the raised position, not allowing the movement of the support platform 190 to be driven downward or the worm 146 to be driven backward or counterclockwise. It is understood that the raising of the support platform 190 away from the support body 102 is also not limited to a single raised position, but that the user can cease rotation of the crank handle 140 at any desired raised position between the upper and lower extent of the rack 180, making the drywall support and lift assembly 100 capable of flexible positioning of the drywall sheet 50 in a wide range of raised positions relative to the support body 102.

When the user does desire to lower the drywall sheet 50 or to lower the support platform 190 once the drywall sheet 50 has been mounted to the wall frame 10, the user can rotate the crank handle 140 in a counterclockwise direction, opposite the arrow 208, to drive downward motion of the support platform 190 and the rack 180 and to return the drywall support and lift assembly 100 to the lowermost position of FIG. 6A.

In accordance with the aspects described herein, the drywall support and lift assembly 100 provides a variety of advantages that can allow a single user to be able to mount the drywall sheet 50 to the wall frame 10 without the need for the assistance of another person. The inclusion of the pin 162 with the pointed end 163 with the mounting portion 160 increases the ease of attachment of the drywall support and lift assembly 100 to the wall frame stud 12 because the gripping of the wall frame stud 12 by the pointed end 163 of the pin 162 reduces the amount of strength required from the user to hold the drywall support and lift assembly 100 in a desired positioning while tightening the bolt 166.

Further, with such ease of attaching the drywall support and lift assembly 100 to the wall frame stud 12, it does not require significant time and/or effort from the user to attach two of the drywall support and lift assemblies 100 to separate wall frame studs 12, which allows the drywall sheet 50 to be supported on two support platforms 190. This, in turn, reduces effort needed from the user in balancing the drywall sheet 50, as it may be stably retained on the two drywall support and lift assemblies 100. This makes it easy to raise and lower the drywall sheet 50 as needed, allowing for very precise positioning. Furthermore, if one of the side edges 56 of the drywall sheet 50 should require trimming, the use of two drywall support and lift assemblies 100 can allow for cutting of the drywall sheet 50 without taking it down from the wall frame 10. For example, the drywall sheet 50 can simply be slid sideways until the side edge 56 that needs to be trimmed is out of alignment with the wall frame studs 12, then the side edge 56 can be scored, cut, and removed with the drywall sheet 50 still resting on the two drywall support and lift assemblies 100. When cutting is complete, the drywall sheet 50 can be slid back into the desired position along the two support platforms 190 for fastening to the wall frame studs 12. The use of the at least one upper retainer 201 lends even further stability for the drywall sheet 50.

Further yet, the drywall support and lift assembly 100 provides even more advantages over previous drywall support assemblies by a lightweight and portable nature. In one non-limiting example, the drywall support and lift assembly 100 may have a total weight of around two pounds or less, making the drywall support and lift assembly 100 easily portable and easily manipulated by the user. Additionally, the use of the worm gear for the lift mechanism for the drywall support and lift assembly 100 provides advantages over known drywall support or lifting assemblies because it ensures that the drywall sheet 50 will be maintained in the desired raised position and will not be caused to lower back down by the weight of the drywall sheet 50 when the user ceases rotation of the crank handle 140.

Conclusion

The foregoing description is merely illustrative in nature and is in no way intended to limit the disclosure, its application, or uses. The broad teachings of the disclosure can be implemented in a variety of forms. Therefore, while this disclosure includes particular examples, the true scope of the disclosure should not be so limited since other modifications will become apparent upon a study of the drawings, the specification, and the following claims. In the written description and claims, one or more steps within a method may be executed in a different order (or concurrently) without altering the principles of the present disclosure. Unless indicated otherwise, numbering or other labeling of instructions or method steps is done for convenient reference, not to indicate a fixed order.

Further, although each of the embodiments is described above as having certain features, any one or more of those features described with respect to any embodiment of the disclosure can be implemented in and/or combined with features of any of the other embodiments, even if that combination is not explicitly described. In other words, the described embodiments are not mutually exclusive, and permutations of one or more embodiments with one another remain within the scope of this disclosure.

The terminology used herein is for the purpose of describing particular exemplary configurations only and is not intended to be limiting. As used herein, the singular articles "a," "an," and "the" may be intended to include the plural forms as well, unless the context clearly indicates otherwise. The terms "comprises," "comprising," "including," and "having," are inclusive and therefore specify the presence of features, steps, operations, elements, and/or components, but do not preclude the presence or addition of one or more other features, steps, operations, elements, components, and/or groups thereof. The method steps, processes, and operations described herein are not to be construed as necessarily requiring their performance in the particular order discussed or illustrated, unless specifically identified as an order of performance. Additional or alternative steps may be employed.

Spatial and functional relationships between elements are described using various terms, including "connected," "engaged," "coupled," "adjacent," "proximate," "next to," "on top of," "above," "below," and "disposed." Unless explicitly described as being "direct," when a relationship between first and second elements is described in the above disclosure, that relationship encompasses a direct relationship where no other intervening elements are present between the first and second elements as well as an indirect relationship where one or more intervening elements are present between the first and second elements. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

The term "set" does not necessarily exclude the empty set-in other words, in some circumstances a "set" may have zero elements. The term "non-empty set" may be used to indicate exclusion of the empty set-in other words, a non-empty set will always have one or more elements. The term "subset" does not necessarily require a proper subset. In other words, a "subset" of a first set may be coextensive with (equal to) the first set. Further, the term "subset" does not necessarily exclude the empty set-in some circumstances a "subset" may have zero elements.

The terms first, second, third, etc. may be used herein to describe various elements, components, regions, layers and/or sections. These elements, components, regions, layers and/or sections should not be limited by these terms. These terms may be only used to distinguish one element, component, region, layer or section from another region, layer or section. Terms such as "first," "second," and other numerical terms do not imply a sequence or order unless clearly indicated by the context. Thus, a first element, component, region, layer or section discussed below could be termed a second element, component, region, layer or section without departing from the teachings of the example configurations.

The term "set" generally means a grouping of one or more elements. The elements of a set do not necessarily need to have any characteristics in common or otherwise belong together. The phrase "at least one of A, B, and C" should be construed to mean a logical (A OR B OR C), using a non-exclusive logical OR, and should not be construed to mean "at least one of A, at least one of B, and at least one of C." The phrase "at least one of A, B, or C" should be construed to mean a logical (A OR B OR C), using a non-exclusive logical OR.

Various example embodiments of the invention are described in the following clauses.

The following Clauses provide an exemplary configuration for a support and lift assembly for a building material, such as a drywall sheet, as described above.

Clause 1: A support assembly for a building material, the support assembly comprising: a mounting portion configured to selectively mount the support assembly to a wall frame; a support platform coupled to the mounting portion and having a support surface configured to support the building material; and a lift mechanism including a rack coupled to the support platform, and a worm gear operably coupled to the rack and rotatably coupled to the mounting portion, the lift mechanism configured to selectively raise and lower the support platform relative to the mounting portion upon rotation of the worm gear.

Clause 2: The support assembly of clause 1 wherein the lift mechanism includes a rack and pinion assembly including: a pinion gear operably coupled with the worm gear such that rotation of the worm gear drives rotation of the pinion gear, and the rack operably coupled with the pinion gear such that rotation of the pinion gear drives linear movement of the rack to selectively raise or lower the support platform.

Clause 3: The support assembly of clause 1 or clause 2 further comprising a rotatable actuator operably coupled to the lift mechanism such that rotation of the rotatable actuator drives rotation of the worm gear.

Clause 4: The support assembly of clause 3 wherein the rotatable actuator is a crank handle.

Clause 5: The support assembly of any of clauses 1 through 4 wherein the building material is a building panel.

Clause 6: The support assembly of clause 5 wherein the building panel is a sheet of drywall or plywood with an edge that at least partially rests on the support surface.

Clause 7: The support assembly of any of clauses 1 through 6 wherein the support platform includes a retaining rib configured to retain the building material against the wall frame.

Clause 8: The support assembly of clause 7 wherein the retaining rib protrudes from the support surface.

Clause 9: The support assembly of any of clauses 1 through 8 wherein the mounting portion includes first and second mounting arms spaced apart from one another and extending parallel to one another.

Clause 10: The support assembly of clause 9 wherein the first and second mounting arms collectively form a clamping mechanism.

Clause 11: The support assembly of clause 9 or clause 10 wherein the first and second mounting arms collectively act as a C-clamp.

Clause 12: The support assembly of any of clauses 9 through 11 wherein one of the first and second mounting arms includes a pin configured to grip into a first side of the portion of the wall frame, and the other of the first and second mounting arms includes a tightenable fastener configured to tighten against a second side, opposite the first side, of the portion of the wall frame.

Clause 13: The support assembly of any of clauses 9 through 12 wherein the mounting portion mounts the support assembly to an upright portion of the wall frame.

Clause 14: The support assembly of clause 13 wherein the upright portion of the wall frame is a portion of a generally vertically positioned wall frame stud and the first and second mounting arms extend along opposite faces of the wall frame stud.

Clause 15: A lift assembly for supporting and raising a building material, the lift assembly comprising: a support body; a support platform movably coupled to the support body and having a support surface configured to support the building material; and a lift mechanism operably coupled to the support platform and configured to selectively raise and lower the support platform relative to the support body, the lift mechanism including: a rotatable actuator coupled to the support body, a worm gear operably coupled to the rotatable actuator, and a rack and pinion assembly operably coupled to the worm gear and to the support platform, the rack and pinion assembly configured to selectively raise and lower the support platform relative to the support body upon rotation of the rotatable actuator and the worm gear.

Clause 16: The lift assembly of clause 15 wherein the rack and pinion assembly includes: a pinion gear operably coupled with the worm gear such that rotation of the worm gear drives rotation of the pinion gear; and a rack operably coupled with the pinion gear such that rotation of the pinion gear drives linear movement of the rack to selectively raise or lower the support platform.

Clause 17: The lift assembly of clause 16 wherein the worm gear includes: a worm drive shaft; a worm wheel operably coupled with the worm drive shaft; and a worm output shaft operably coupled with the worm wheel such that rotation of the worm wheel rotates the worm output shaft.

Clause 18: The lift assembly of clause 17 wherein rotation of the worm drive shaft about a first axis of rotation drives rotation of the worm wheel about a second axis of rotation, further wherein the first and second axes of rotation are generally orthogonal to one another.

Clause 19: The lift assembly of clause 18 wherein the worm wheel, the worm output shaft, and the pinion gear are coaxially rotatable about the second axis of rotation.

Clause 20: The lift assembly of clause 18 or clause 19 wherein the linear movement of the rack is generally orthogonal to both the first and second axes of rotation.

The invention claimed is:

1. A support assembly for a building material, the support assembly comprising:

a mounting portion configured to selectively mount the support assembly to a wall frame;

a support body;

a support platform coupled to the mounting portion and movably coupled to the support body, the support platform having a support surface and a sidewall extending from the support surface, wherein:

the support surface is configured to support the building material, and the sidewall is configured to at least partially surround an upper portion of the support body; and a lift mechanism including a rack coupled to the support platform, and a worm gear operably coupled to the rack and rotatably coupled to the mounting portion, the lift mechanism configured to selectively raise and lower the support platform relative to the mounting portion upon rotation of the worm gear.

2. The support assembly of claim 1 wherein:

the lift mechanism includes a pinion gear operably coupled with the worm gear such that rotation of the worm gear drives rotation of the pinion gear, and the rack is operably coupled with the pinion gear such that rotation of the pinion gear drives linear movement of the rack to selectively raise or lower the support platform.

3. The support assembly of claim 2 further comprising a rotatable actuator operably coupled to the lift mechanism such that rotation of the rotatable actuator drives rotation of the worm gear.

4. The support assembly of claim 3 wherein the rotatable actuator is a crank handle.

5. The support assembly of claim 1 wherein the building material is a building panel.

6. The support assembly of claim 5 wherein the building panel is a sheet of drywall or plywood with an edge that at least partially rests on the support surface.

7. The support assembly of claim 1 wherein the support platform includes a retaining rib configured to retain the building material against the wall frame.

8. The support assembly of claim 7 wherein the retaining rib protrudes from the support surface.

9. The support assembly of claim 1 wherein the mounting portion includes first and second mounting arms spaced apart from one another and extending parallel to one another.

10. The support assembly of claim 9 wherein the first and second mounting arms collectively form a clamping mechanism.

11. The support assembly of claim 10 wherein the first and second mounting arms collectively act as a C-clamp.

12. The support assembly of claim 10 wherein one of the first and second mounting arms includes a pin configured to grip into a first side of the wall frame, and the other of the first and second mounting arms includes a tightenable fastener configured to tighten against a second side, opposite the first side, of the wall frame.

13. The support assembly of claim 10 wherein the mounting portion mounts the support assembly to an upright portion of the wall frame.

14. The support assembly of claim 13 wherein the upright portion of the wall frame is a portion of a generally vertically positioned wall frame stud and the first and second mounting arms extend along opposite faces of the wall frame.

15. A lift assembly for supporting and raising a building material, the lift assembly comprising:

a support body;

a support platform movably coupled to the support body and having a support surface and a sidewall extending from the support surface, wherein:

the support surface is configured to support the building material, and the sidewall is configured to at least partially surround an upper portion of the support body; and a lift mechanism operably coupled to the support platform and configured to selectively raise and lower the support platform relative to the support body, the lift mechanism including:

a rotatable actuator coupled to the support body, a worm gear operably coupled to the rotatable actuator, and a rack and pinion assembly operably coupled to the worm gear and to the support platform, the rack and pinion assembly configured to selectively raise and lower the support platform relative to the support body upon rotation of the rotatable actuator and the worm gear.

16. The lift assembly of claim 15 wherein the rack and pinion assembly includes:

a pinion gear operably coupled with the worm gear such that rotation of the worm gear drives rotation of the pinion gear; and a rack operably coupled with the pinion gear such that rotation of the pinion gear drives linear movement of the rack to selectively raise or lower the support platform.

17. The lift assembly of claim 16 wherein the worm gear includes:

a worm drive shaft;

a worm wheel operably coupled with the worm drive shaft; and a worm output shaft operably coupled with the worm wheel such that rotation of the worm wheel rotates the worm output shaft.

18. The lift assembly of claim 17 wherein rotation of the worm drive shaft about a first axis of rotation drives rotation of the worm wheel about a second axis of rotation, further wherein the first and second axes of rotation are generally orthogonal to one another.

19. The lift assembly of claim 18 wherein the worm wheel, the worm output shaft, and the pinion gear are coaxially rotatable about the second axis of rotation.

20. The lift assembly of claim 19 wherein the linear movement of the rack is generally orthogonal to both the first and second axes of rotation.

21. A support assembly for a building material, the support assembly comprising:

a mounting portion configured to selectively mount the support assembly to a wall frame, the mounting portion including a first mounting arm and a second mounting arm, wherein:

the first mounting arm and the second mounting arm collectively form a clamping mechanism, one of the first mounting arm and the second mounting arm includes a pin configured to grip into a first side of the wall frame, and the other of the first mounting arm and the second mounting arm includes a tightenable fastener configured to tighten against a second side, opposite the first side, of the wall frame;

a support platform coupled to the mounting portion and having a support surface configured to support the building material; and a lift mechanism including a rack coupled to the support platform, and a worm gear operably coupled to the rack and rotatably coupled to the mounting portion, the lift mechanism configured to selectively raise and lower the support platform relative to the mounting portion upon rotation of the worm gear.

* * * * *